US007025282B2

(12) United States Patent
Hong

(10) Patent No.: US 7,025,282 B2
(45) Date of Patent: Apr. 11, 2006

(54) COVERED BUBBLER HEAD FOR A DRINKING FOUNTAIN

(75) Inventor: Sam T. Hong, Sparks, NV (US)

(73) Assignee: Haws Drinking Faucet Company, Sparks, NV (US)

( * ) Notice: Subject to any disclaimer, the term of this patent is extended or adjusted under 35 U.S.C. 154(b) by 0 days.

(21) Appl. No.: 10/888,456

(22) Filed: Jul. 8, 2004

(65) Prior Publication Data

US 2005/0023370 A1 Feb. 3, 2005

Related U.S. Application Data

(60) Provisional application No. 60/491,209, filed on Jul. 29, 2003.

(51) Int. Cl.
*B05B 12/14* (2006.01)

(52) U.S. Cl. ..... 239/24; 239/28; 239/29; 239/30; 239/288.5; 239/204

(58) Field of Classification Search ..... 239/24–33, 239/288–288.5, 203, 204; 137/377–381; 222/108

See application file for complete search history.

(56) References Cited

U.S. PATENT DOCUMENTS

| | | | | | |
|---|---|---|---|---|---|
| 2,757,045 | A | * | 7/1956 | Nullet | 239/204 |
| 3,033,466 | A | * | 5/1962 | Sorensen | 239/32 |
| 3,113,723 | A | * | 12/1963 | Arnt | 239/29 |
| 4,145,003 | A | * | 3/1979 | Harrison et al. | 239/288 |
| 4,681,259 | A | * | 7/1987 | Troup et al. | 239/206 |
| 4,781,327 | A | * | 11/1988 | Lawson et al. | 239/203 |
| 5,060,857 | A | * | 10/1991 | Engelbach | 239/32 |

* cited by examiner

*Primary Examiner*—David A. Scherbel
*Assistant Examiner*—Seth Barney
(74) *Attorney, Agent, or Firm*—Kelly Lowry & Kelley, LLP

(57) ABSTRACT

A protective cover is provided for substantially enclosing and protecting a bubbler head of a drinking fountain or the like against contamination when water flow to the bubbler head is turned off. In one preferred form, when the water flow is turned on, the protective cover is hydraulically elevated or pops up to a raised position permitting substantially unimpeded projection of a water stream from the bubbler head for drinking, etc. In an alternative preferred form, the bubbler head is hydraulically elevated or pops to a raised position within a stationary protective cover when the water supply is turned on for substantially unimpeded projection of water stream from the bubbler head through an open flow port formed in the cover.

15 Claims, 5 Drawing Sheets

COVERED BUBBLER HEAD FOR A DRINKING FOUNTAIN

This application claims the benefit of U.S. Provisional Application 60/491,209, filed Jul. 29, 2003.

BACKGROUND OF THE INVENTION

This invention relates generally to improvements in drinking fountains and the like, and in bubbler heads for use with such drinking fountains to project a stream of water for drinking. More particularly, this invention relates to a protective cover for a fountain bubbler head, for substantially enclosing the bubbler head to preclude contamination thereof when a water supply thereto is turned off. When the water supply is turned on, the protective cover is hydraulically elevated or pops up to permit substantially unimpeded projection of a water stream from the bubbler head.

Bubbler heads are commonly provided in drinking fountains and the like to produce a controlled water stream accessible for drinking in response to operation of a user-accessible valve. The bubbler head is typically mounted on a fountain housing at a position generally over a drain bowl or basin. The valve such as a pushbutton or lever-type valve is mounted on the fountain housing at a convenient location and is in a normally closed position for disconnecting or turning off a water supply coupled thereto. The valve can be manipulated by a person desiring a drink of water to turn on the water supply and thereby couple a flow of water under pressure to the bubbler head. The bubbler head is designed for projecting the discharged water stream typically with an upwardly arched configuration over the drain basin. Release of the valve disconnects the water flow to halt the projected water stream.

In some fountain installations, the bubbler head may be exposed on occasion to undesirable contaminants, such as reclaimed or recycled water used is some irrigation systems for golf courses and the like. Such reclaimed water is generally considered to be non-potable, whereby there is a concern that the bubbler head of a drinking fountain may become contaminated if contacted by such reclaimed water during an irrigation cycle.

There exists, therefore, a need for improvements in and to bubbler heads for drinking fountains, wherein the bubbler head is effectively safeguarded against undesired contamination. The present invention fulfills these needs and provides further related advantages.

SUMMARY OF THE INVENTION

In accordance with the invention, an improved bubbler head for a drinking fountain or the like includes a pop-up protective cover or cap for preventing bubbler head contact with undesired contaminants, such as contact by recycled or reclaimed water used in an irrigation system for a golf course or the like. The protective cover is normally retracted to a position substantially enclosing and protecting the bubbler head when a water supply is turned off, but hydraulically pops up to an elevated or raised position when the water supply is turned on. In the elevated position, the protective cover is hydraulically retained in a substantially out-of-the-way position to permit substantially unimpeded upwardly arched projection of a water stream from the bubbler head for drinking, etc.

In one preferred form, the bubbler head is mounted generally over or at one side of a drain bowl or basin, and is adapted to receive a flow of water under pressure from a suitable water source or supply via a control valve mounted typically at a convenient user-accessible position on a fountain housing. The bubbler head defines an internal pressure cylinder which slidably carries a piston coupled by a piston rod to the protective cover of generally inverted cup-shaped configuration. A laterally open discharge port is formed in the bubbler head for laterally upward and outward discharge of an upwardly arched water stream, when the control valve is actuated to turn on the water supply. A flow restrictor is carried within this discharge port for regulating the flow rate and volume of the discharged water stream and for maintaining a minimum threshold pressure within the pressure cylinder.

When the water supply is turned on by operation of the control valve, water under pressure is coupled to the pressure cylinder at a location below the piston, resulting in hydraulic piston displacement to lift the protective cover from the normal retracted position to the popped up, elevated position. In this elevated position, a lower margin of the protective cover is raised sufficiently above the water stream projected from the discharge port to preclude interference therewith. The flow restrictor regulates and maintains the water pressure within the cylinder at a sufficient level to retain the protective cover in the elevated position. When the water supply is turned off, as by releasing the control valve, water within the pressure cylinder is drained through a small bleed port resulting in downward displacement of the protective cover by gravity to the normal retracted position in substantially enclosing relation with the bubbler head.

In one alternative preferred form of the invention, the piston incorporates the bubbler head having the laterally open discharge port formed therein, wherein the bubbler head is slidably received with a stationary protective cover having an open flow port formed therein. When the water supply is turned on, the combination piston/bubbler head is hydraulically displaced to an elevated or popped up position with the bubbler head discharge port aligned with the cover flow port for substantially unimpeded outward projection of a water stream therefrom. Conversely, when the water supply is turned off, the combination piston/bubbler head displaced downwardly for misalignment of the bubbler head discharge port with the cover flow port. A spring reacting between the combination piston/bubbler head and protective cover may be provided to assist such downward displacement when the water supply is turned off.

Other features and advantages of the present invention will become more apparent from the following detailed description taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
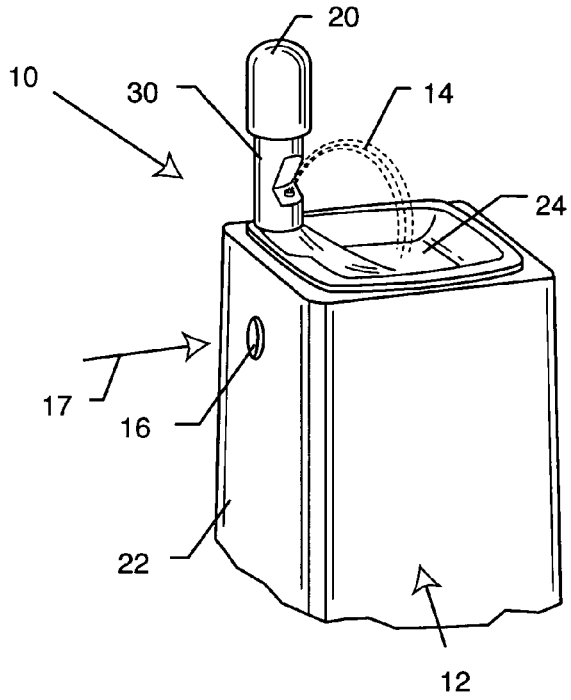
FIG. 1 is a fragmented perspective view of a drinking fountain incorporating a covered bubbler head in one preferred form in accordance with the novel features of the present invention, and showing a protective cover in a raised or elevated position during discharge of a water stream from the bubbler head.
Figure 2:
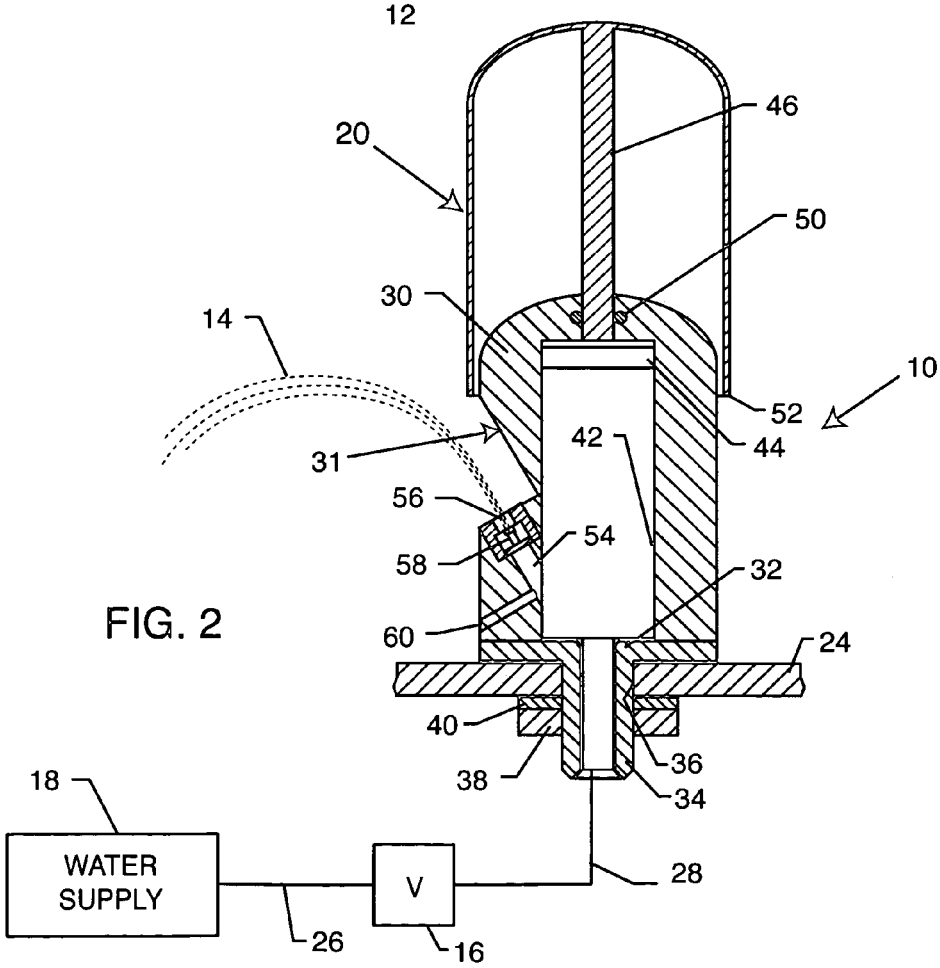
FIG. 2 is an enlarged and somewhat schematic vertical section view of the covered bubbler head of FIG. 1, illustrating the protective cover in the elevated position during water stream discharge from the bubbler head.

As shown in the exemplary drawings, an improved covered bubbler head referred to generally by the reference numeral 10 in FIG. 1 is provided for use in a drinking fountain 12 to provided an upwardly arched stream 14 of water (FIGS. 1–2) for drinking, etc., in response to manipulation of a user-accessible control valve 16 for turning on the fountain by coupling the bubbler head 10 to a suitable water source or supply 18 (FIG. 2). In accordance with a preferred form of the invention as viewed in FIGS. 1–4, a pop-up protective cover or cap 20 is provided for hydraulic movement to a raised or elevated position (FIGS. 1–2) when the fountain is turned on to permit normal upward projection of the water stream 14. However, when the fountain is turned off, the protective cover 20 descends to a lowered or retracted position (FIGS. 3–4) substantially enclosing and covering the bubbler head 10 to safeguard the bubbler head against contact with undesired contaminants.

The bubbler head 10 with the protective cover 20 of the present invention is particularly designed for use in outdoor drinking fountain installations wherein the exposed outer surfaces of the drinking fountain 12 may be exposed from time to time to undesired potential contaminants, such as recycled or reclaimed water used to irrigate certain terrain areas such as a golf course or the like. If such potential contaminants are allowed to contact external surfaces of the bubbler head 10, there is concern that bubbler head sanitation may be compromised, and/or that such contaminants may provide a source for unhealthy growth of bacterial organisms and the like on the bubbler head 10. The protective cover 20 is provided for shielding the otherwise externally exposed surfaces of the bubbler head 10, whenever the drinking fountain 12 is turned off, thereby safeguarding such surfaces against contact by reclaimed water used for irrigation as well as contact by other forms of airborne or human-transported contaminants.

FIG. 1 illustrates the bubbler head 10 mounted onto the upper end of an exemplary drinking fountain 12. The fountain 12 generally comprises an upright fountain housing 22 having a conventional drain bowl or basin 24 at the upper side thereof. The bubbler head 10 is shown positioned generally at one side of the drain basin 24. The control valve 16 such as the illustrative pushbutton-type valve may be mounted in a convenient exposed position as shown for user access to turn the fountain on and off. In this regard, the control valve 16 has an inlet side connected by a water supply conduit 26 to the water supply 18 (FIG. 2), such as a domestic or municipal source of potable water under pressure. An outlet side of the control valve 16 is coupled by a water flow conduit 28 to the bubbler head 10. In accordance with a typical control valve construction, the valve 16 is normally closed to turn off the fountain 12, i.e., to prevent water flow through the conduit 28 to the bubbler head 10. However, when the control valve 16 is appropriately manipulated by a fountain user, as by pushing inwardly on the illustrative pushbutton-type valve 16 as depicted by arrow 17 in FIG. 1, the fountain 12 is turned on, i.e., the water supply 18 is coupled to the flow conduit 28 for flow to the bubbler head.

Figure 4:
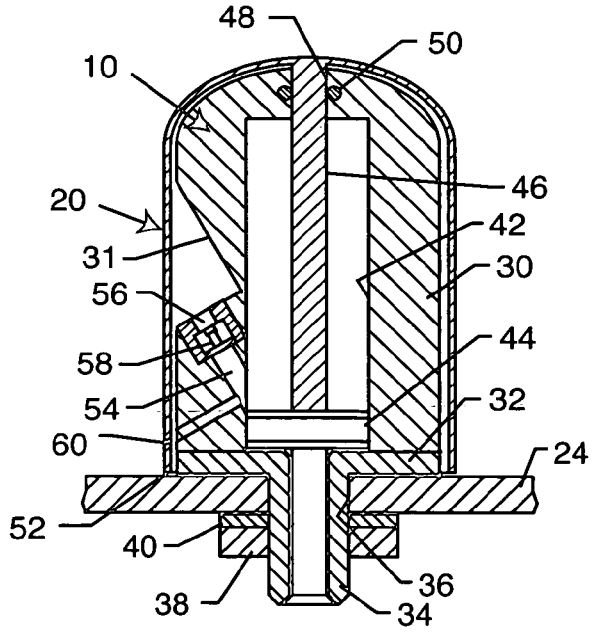
FIG. 4 is an enlarged vertical section view similar to FIG. 2, but showing the protective cover in the retracted position.

As viewed best in FIGS. 2 and 4, the bubbler head 10 comprises a generally cylindrical body 30 adapted for mounting onto the fountain 12 in a position such as generally at one side of the drain basin 24. A lower end of the body 30 includes or is connected to an inlet fitting 32 defining an inlet nipple 34 extending downwardly through a port 36 formed in the periphery of the basin 24 for suitable connection to a downstream end of the water flow conduit 28 (FIG. 2). This nipple 34 may be externally threaded for securement relative to the basin periphery by means of a threaded nut 38 and washer 40, or other suitable fastener means.

The inlet fitting 32 provides an open flow path for entry of water under pressure, when the fountain is turned on, into a lower end of a generally vertically elongated internal pressure cylinder 42 formed within the body 30 of the bubbler head 10. A piston 44 is slidably carried within this pressure cylinder 42 for upward displacement therein in response to water inflow into the lower end of the cylinder 42. This piston is mounted at a lower end of an upwardly extending piston rod 46 which projects upwardly through a port 48 at an upper end of the cylinder 42 and is connected above the bubbler head 10 to an inboard side of the protective cover 20. A seal ring 50 such as an O-ring seal or the like lines the port 48 to prevent water leakage therethrough.

Figure 3:
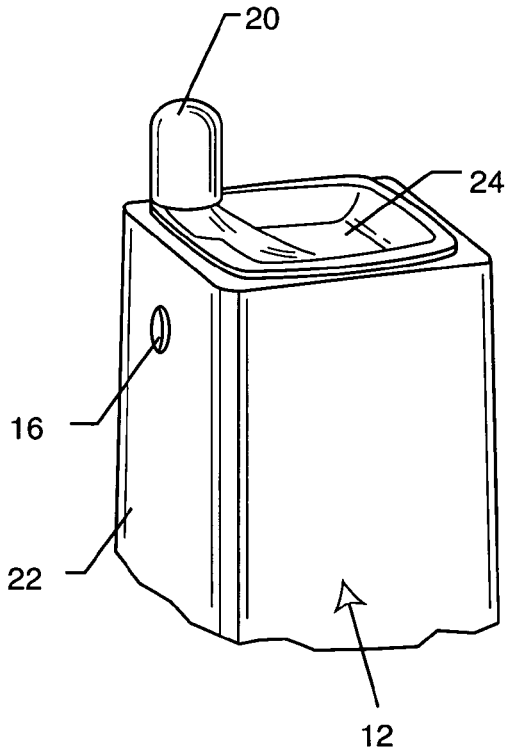
FIG. 3 is a fragmented perspective view similar to FIG. 1, but depicting the protective cover in a retracted position substantially enclosing the protecting the bubbler head.

The protective cover or cap 20 has an inverted, generally cup-shaped configuration with a size and shape for substantially enclosing, shielding, and preferably slidably mating fit over the body 30 of the bubbler head 10, which may have a rounded upper end as shown (FIGS. 2 and 4). Accordingly, the protective cover 20 thereby conceals the exterior surfaces of the bubbler head 10 which would otherwise be exposed at the exterior of the fountain 12. FIGS. 3–4 show the protective cover 20 in a normal lowered or retracted position with a lower marginal edge 52 positioned substantially at or resting upon an upwardly exposed surface of the basin periphery. In this retracted position, the cup-shaped cover 20 is substantially matingly fitted over the bubbler head 10, and the piston 44 is in a descended position disposed substantially at a lower end of the pressure cylinder 42.

When the fountain is turned on, water under pressure is supplied through the inlet fitting 32 into the lower end of the pressure cylinder 42. This results in hydraulic lifting of the piston 44 to displace the protective cover 20 toward the elevated or popped up position as viewed in FIGS. 1–2. That is, as the piston 44 ascends within the cylinder 42 in response to the hydraulic pressure, the piston rod 46 correspondingly lifts the protective cover 20 to the elevated position.

Such pop-up movement of the protective cover 20 exposes a laterally open discharge passage 54 formed in the body 30, for outward projection of the water stream 18. More particularly, this discharge passage 54 is formed in the body 30 of the bubbler head 10 with an upstream end communicating with the pressure cylinder at a location spaced slightly above the piston 44, when the fountain is turned off (FIG. 4). As the piston 44 is displaced upwardly within the pressure cylinder 42 when the fountain is turned on, the upstream end of the discharge passage 54 is exposed to water inflow from the pressure cylinder 42. The discharge passage 54 is formed to extend at an angle laterally upwardly and outwardly, terminating in a nozzle port 56 (FIG. 2) through which the water stream 18 is projected in an upwardly arched configuration. As shown, one side of the cylindrical body 30 is suitably relieved, as indicated by arrows 31 (FIGS. 2 and 4) to accommodate unrestricted upward and outward projection or trajection of the water stream 14.

A flow restrictor 58 such as a resilient annular restrictor ring or the like is desirably seated within the nozzle port 56 for regulating the projected water stream 18, and also for maintaining a minimum threshold pressure within the pressure cylinder 42. Such minimum threshold pressure is selected to be sufficient for retaining the pop-up cover 20 in the elevated position, whereat the lower marginal edge 52 of the cover 20 is sufficiently elevated to avoid interfering with the projected water stream 18.

When the fountain 12 is subsequently turned off, hydraulic pressure within the pressure cylinder 42 is relieved by draining residual water from the pressure cylinder to the basin 24 through a small bleed port 60 extending angularly in a laterally outward and downward direction from a lower end of the discharge passage 54. This permits the piston 44 to descend by gravity action within the pressure cylinder 42 for return movement to the normal retracted position substantially overlying, enclosing and covering or concealing the bubbler head 10, as viewed in FIGS. 3–4. In this regard, the mass provided by the piston 44, piston rod 46, and protective cover 20 is sufficient for reliable gravity-based downward movement of the cover 20, when the water supply to the bubbler head 10 is turned off.

Accordingly, the present invention provides a simple yet highly effective means for safeguarding a bubbler head 10 in a drinking fountain 12 against contact with undesired contaminants, whenever the fountain is in an off condition. However, when the fountain is turned on, the bubbler head 10 is sufficiently exposed for normal and intended operation to produce an upwardly arched water stream 18 for drinking, etc. Upon subsequent return of the fountain to the off condition, the bubbler head 10 is promptly and automatically re-covered.

Figure 5:
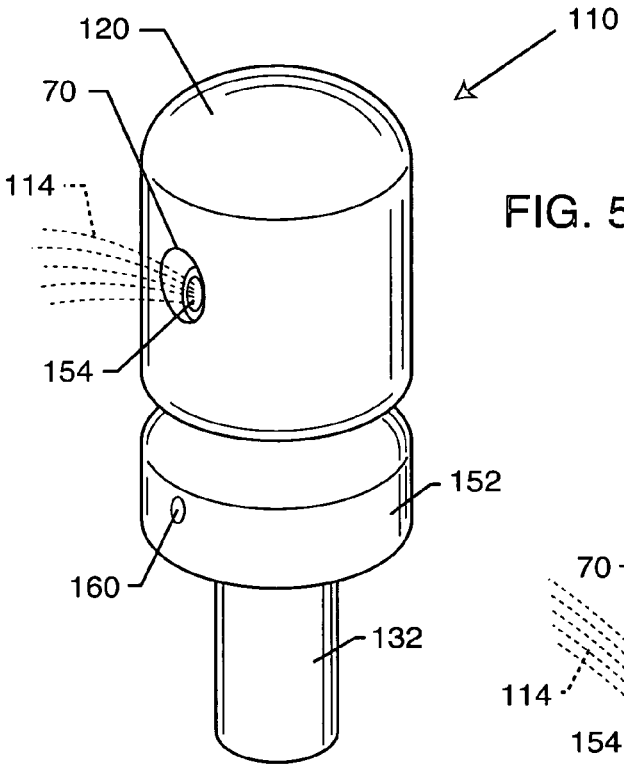
FIG. 5 is a perspective view depicting a covered bubbler head in accordance with one alternative preferred form of the invention.
Figure 6:
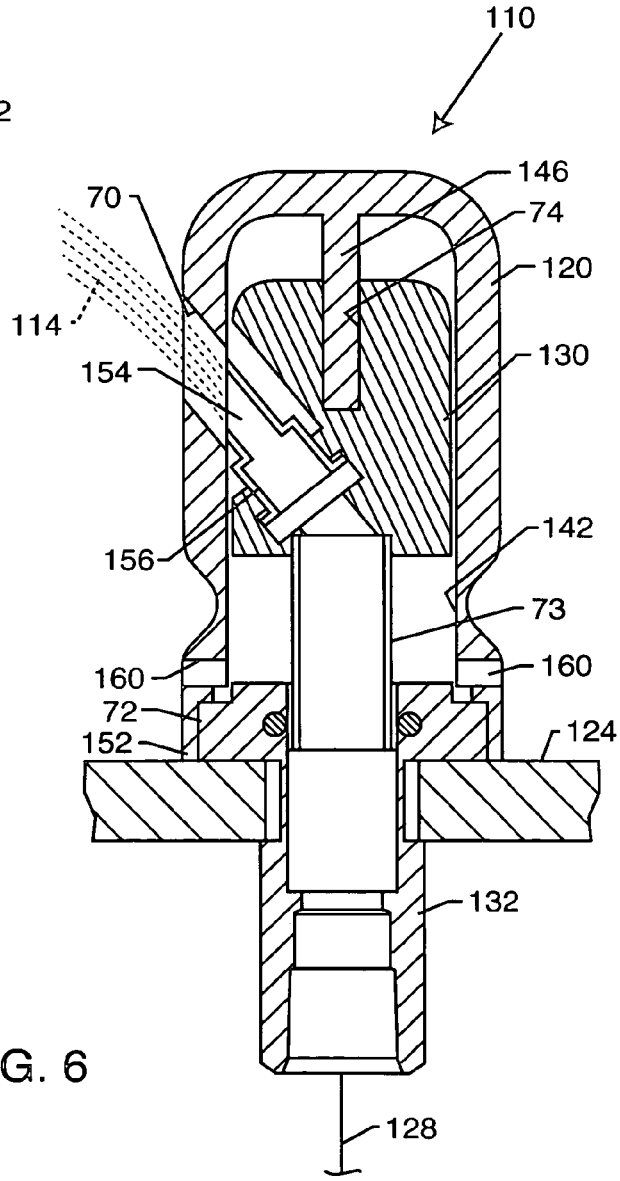
FIG. 6 is an enlarged and somewhat schematic vertical sectional view of the covered bubbler head of FIG. 5, illustrating a pop-up bubbler head in an elevated position during water stream discharge therefrom.
Figure 7:
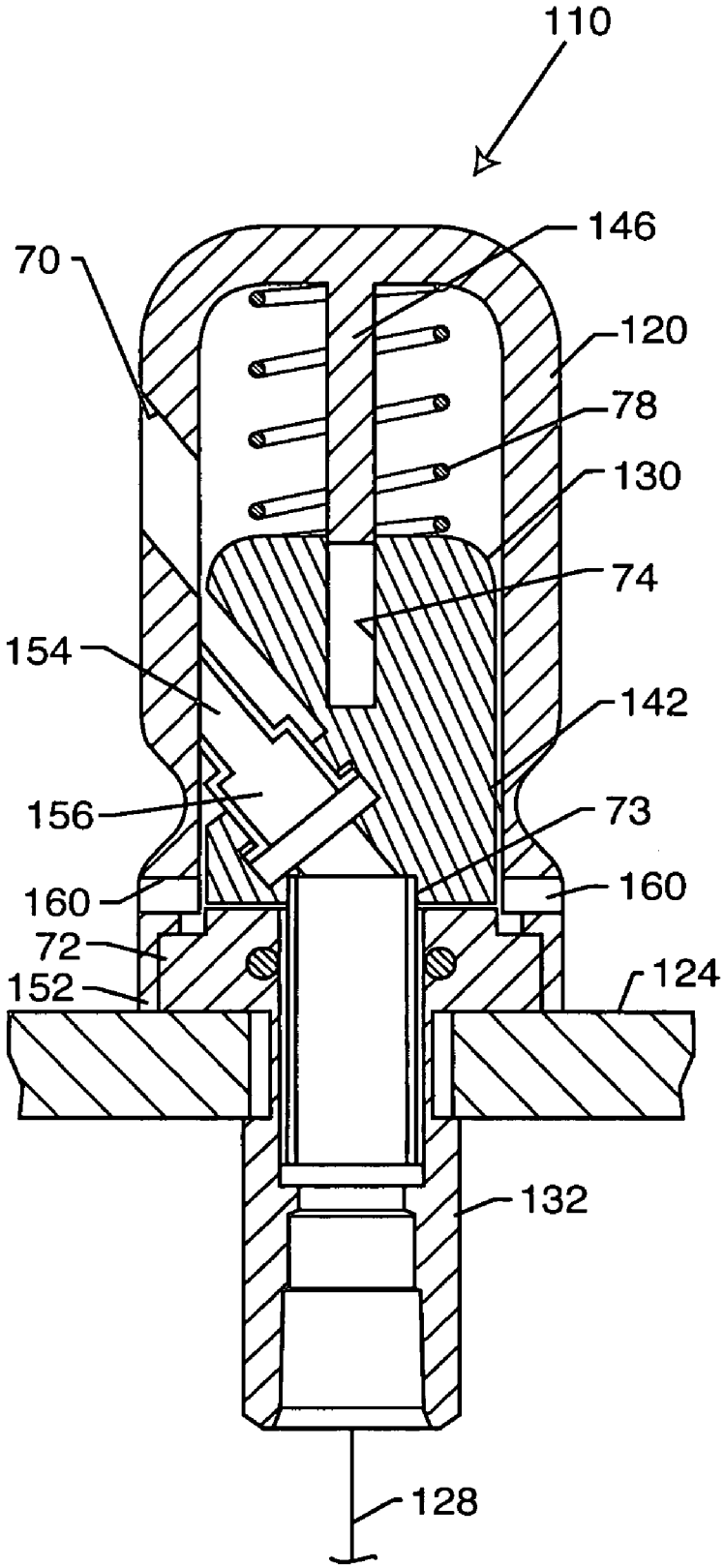
FIG. 7 is an enlarged and somewhat schematic vertical sectional view similar to FIG. 6, but showing the pop-up bubbler head in a retracted position, and further illustrating an optional retraction spring reacting between a protective cover and the bubbler head.

One alternative preferred form of the invention is depicted in FIGS. 5–7, wherein components corresponding in structure and/or function with those shown and described in FIGS. 1–4 are identified by common reference numerals increased by 100. As shown, a modified covered bubbler head 110 incorporates a pop-up bubbler head body 130 (FIGS. 6–7) slidably mounted within a stationary protective cover or cap 120. When the head 110 is coupled with a supply of water under pressure, the bubbler head body 130 is hydraulically elevated within the cover 120 to align and thereby expose a laterally open discharge port 154 therein with a laterally open flow port 70 formed in the cover 120, thereby accommodating substantially unimpeded outward projection of a water stream 114 (FIGS. 5–6). However, when the water supply is turned off, the bubbler head body 130 hydraulically retracts within the protective cover 120, thereby misaligning the bubbler head discharge port 154 from the cover flow port 70 to cover and protect the bubbler head discharge port 154 against contact with contaminants.

More particularly, the modified covered bubbler head 110 (FIGS. 5–7) includes an inlet fitting 132 adapted for suitable mounting onto the fountain, as by connection with the basin 124 as previously described with respect to FIGS. 1–4. An upper end of this inlet fitting 132 defines a base member 72 for connection with a lower marginal edge 152 of the inverted, generally cup-shaped protective cover 120. A lower end of this inlet fitting 132 is adapted for suitable connection with a downstream end of a water supply conduit 128.

The bubbler head body 130 comprises a combination piston/bubbler head, or piston body, adapted for vertical sliding displacement within the cover 120. A lower end of this body 130 includes a sleeve member 73 with an open lower end in flow communication with water under pressure supplied via the inlet fitting 132, and an upper end in flow communication with the laterally open discharge port 154 which may incorporate a ported nozzle 156 as previously described. This sleeve member 73 fits slidably through the inlet fitting 132 with sufficient clearance to accommodate water flow between the sleeve member 73 and inlet fitting 132 into a lower pressure cylinder 142 defined by the cover interior at the underside of the bubbler head body 130. A guide bore 74 formed in an upper face of the body 130 slidably receives a depending guide rod or pin 146 projecting downwardly from an inboard side of the cover 120.

When the water supply is turned on, water under pressure is coupled to the pressure cylinder 142 causing the bubbler head body 130 to hydraulically elevate within the protective cover 120. The sleeve member 73 and the guide rod 146 slidably guide the bubbler head body 130 through such displacement. In addition, the water under pressure is coupled via the sleeve member 73 to the laterally open discharge port 154. As shown in FIG. 6, in the hydraulically elevated position, the laterally open discharge port 154 is aligned with the laterally open flow port 70 in the cover 120 for outward projection of the water stream 114 substantially without interference. When the water supply is turned off, the bubbler head body 130 retracts by gravity to a retracted or lower position as viewed in FIG. 7, with the discharge flow port 154 misaligned with the flow port 70 formed in the cover 120, and thereby covered or concealed by the cover 120. Water within the pressure cylinder 146 may bleed through one or more bleed ports 160 formed in the cover 120, to accommodate retraction of the bubbler head body 130. In addition, such retraction may be assisted by an optional spring 78 (FIG. 7) reacting between the top of the body 130 and an underside or inboard surface of the protective cover 120.

Figure 8:
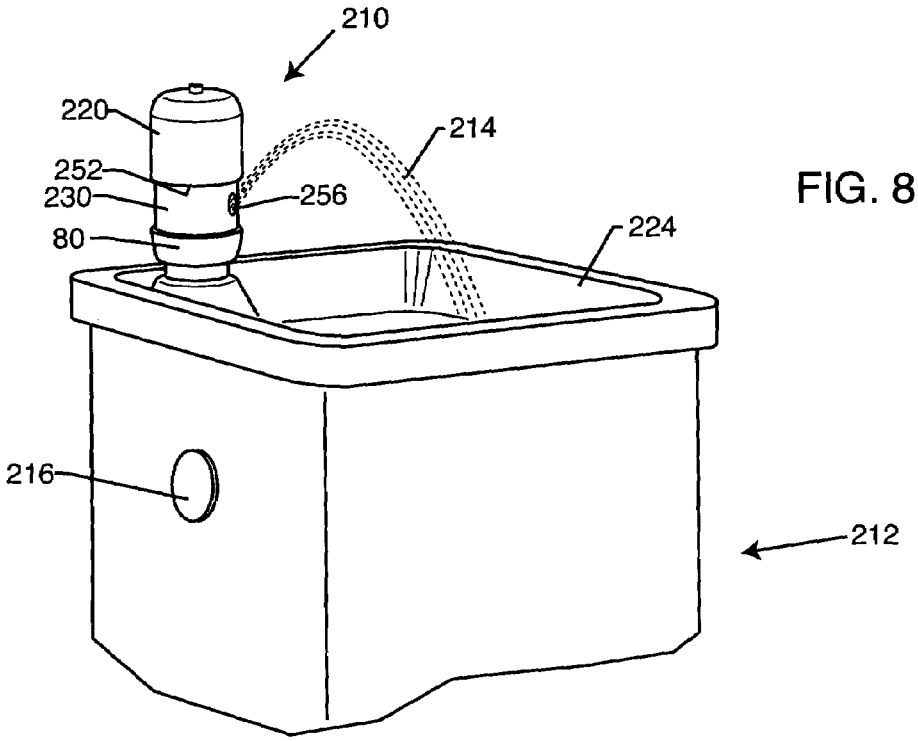
FIG. 8 is a fragmented perspective view of a drinking fountain similar to FIG. 1, but depicting a further alternative preferred form of the invention.
Figure 9:
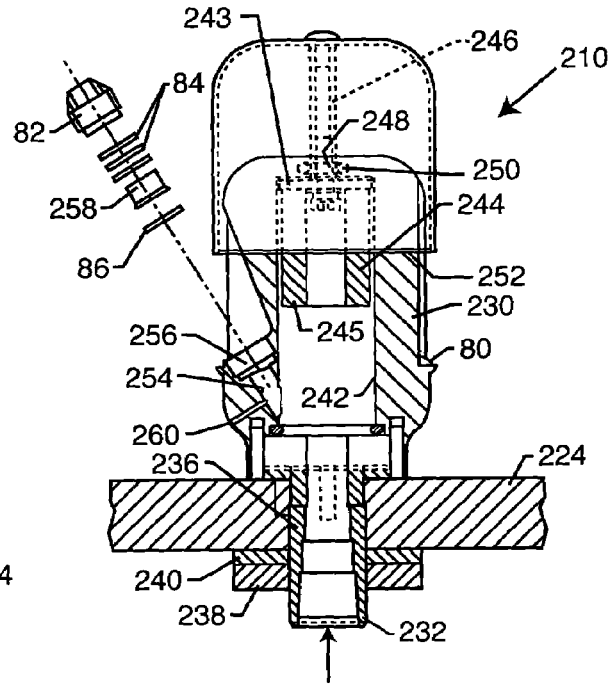
FIG. 9 is an enlarged and somewhat schematic vertical section view of the covered bubbler head of FIG. 8, illustrating the protective cover in the elevated position during water stream discharge from the bubbler head.
Figure 10:
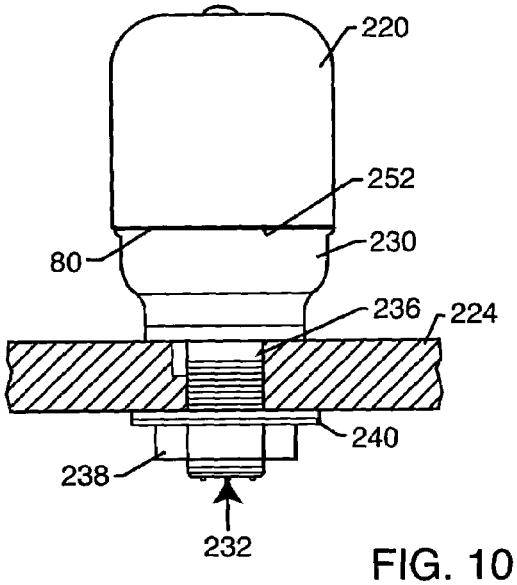
FIG. 10 is a fragmented perspective view similar to FIG. 9, but depicting the protective cover of FIGS. 8–9 in a retracted position substantially enclosing the protecting the bubbler head.

A further alternative preferred form of the invention is shown in FIGS. 8–10, wherein components corresponding in structure and/or function with those shown and described in FIGS. 1–4 are identified by common reference numerals increased by 200. As shown, a modified covered bubbler head 210 is provided on a drinking fountain 212 or the like, with a protective cover 220 adapted for hydraulically actuated pop-up displacement to an elevated position (FIGS. 8–9) for projecting a water stream 214 outwardly over a fountain basin 24 or the like, upon actuation of a user-accessible control valve 216 or the like. When the fountain is turned off, the protective cover 220 descends to a lowered or retracted position (FIG. 10) with a lower marginal edge 252 of the cover 220 seated upon a peripheral rim or lip 80 formed on the body 230 of the bubbler head 210 at a location at least slightly below a laterally open discharge passage 254 and associated nozzle port 256 therein.

More particularly, as shown best in FIG. 9, the bubbler head 210 comprises a generally cylindrical nozzle body 230 having a lower inlet fitting 232 adapted to fit downwardly through a port 236 formed, e.g., at one side of the drain basin 224, and for suitable mounting therein as by means of a threaded nut 238 and one or more washers 240. The inlet fitting 232 is coupled via the control valve 216 to a suitable source (not shown) of potable water. When the control valve 216 is depressed to turn the fountain on, the water supply is coupled a hollow internal pressure cylinder 242 within the nozzle body 230, to act upon and displace upwardly a piston 244 mounted therein. As shown, the piston 244 is slidably carried within the cylinder 242 and is connected by a piston rod 246 extending through a port 248 formed in the top of the body 230 to the protective cover 220 of generally inverted, cup-shaped configuration. When the fountain is turned on, the water pressure within the cylinder 242 elevates the piston 244 for correspondingly elevating the protective cover 220 sufficiently to expose the laterally open water stream discharge passage 254 and associated nozzle port 256.

In a preferred form, the piston 244 as viewed in FIG. 9 comprises an upper seal member 243 formed from a resilient or elastomer material with a generally circular or disk configuration. This seal member 243 is fastened or otherwise suitably connected to a lower end of the piston rod 246. A cylindrical float 245 has an upper end secured to an underside surface of the seal member 243 and extends downwardly therefrom within the pressure cylinder 242. In operation, when water under pressure is supplied via the inlet fitting 236 into the pressure cylinder 242, the piston 244 comprising the seal member 243 and float 245 are translated upwardly in a rapid manner, and requiring a minimal volume of water as a result of the float 245, toward the elevated position shown in FIG. 9. In this elevated position, the resilient seal member 243 engages an upper end of the pressure chamber 242, thereby covering a lower end of the port 248. Accordingly, the seal member 243 positively closes and seals the upper end of the pressure cylinder 242 against any residual water leakage past the O-ring 250 lining the port 248 through which the piston rod extends. With this arrangement, the O-ring 250 can be sized for relatively low resistance to gravity return of the piston 244 to the normal retracted position, when the fountain is turned off as will be described in more detail.

With the protective cover elevated as viewed in FIGS. 8–9, water within the pressure cylinder 242 may flow upwardly and outwardly through the nozzle port 256 to projection therefrom in the form of the water stream 214. The nozzle port conveniently includes a nozzle 82, one or more filter screens 84, a flow control element or flow restrictor 258, and a resilient washer 86 seated at an inboard or upstream end thereof. In the elevated position, the protective cover 220 permits unobstructed outward projection of the water stream 214. However, when the fountain is turned off, the pressure within the cylinder 242 is relieved as by means of a bleed port 260 or the like, thereby permitting gravity-induced descending movement of the cover 220 to the initial or normal retracted position with the lower marginal edge 252 thereof seated on the rim or lip 80 which projects radially outwardly a short distance from the nozzle body 230 at a location below the open end defined by the nozzle port 256. In this retracted position, the protective cover overlies and conceals and thereby protects the nozzle port 256 and the nozzle components mounted therein against contact with potential external contaminants.

A variety of modifications and improvements in and to the improved bubbler head with pop-up protective cover of the present invention will be apparent to those persons skilled in the art. For example, features incorporated into the various alternative embodiments may be incorporated into other embodiments disclosed herein. Accordingly, no limitation on the invention is intended by way of the foregoing description and accompanying drawings, except as set forth in the appended claims.

What is claimed is:

1. In a drinking fountain adapted for connection to a supply of water under pressure and including a bubbler head body having a discharge port for outward projection of a water stream therefrom upon connection to the pressurized water supply, and a control valve for selectively turning the fountain on and off by respectively connecting and disconnecting the pressurized water supply from the bubbler head body, the improvement comprising:

a protective cover having a generally inverted cup-shaped configuration with a substantially closed upper end, said protective cover slidably carried on said bubbler head body and having said bubbler head body mounted therein for relative sliding displacement therebetween; and means for hydraulically displacing said cover relative to said bubbler head body to an elevated position when the fountain is turned on to expose the bubbler head discharge port for substantially unimpeded outward water stream projection, and for displacing said cover relative to said bubbler head body to a retracted position when the fountain is turned off whereby said cover substantially overlies and conceals said bubbler head discharge port.

2. The improvement of claim 1 wherein said bubbler head body includes a radially outwardly projecting rim formed thereon for supporting a lower marginal edge of said cover in said retracted position.

3. The improvement of claim 1 wherein said hydraulic displacing means comprises a pressure chamber formed in said bubbler head body for connection to the pressurized water supply when the fountain is turned on, and a piston carried by said protective cover and slidably mounted within said pressure chamber, whereby said piston is movably displaced within said pressure chamber when the fountain is turned on for displacing said cover from said retracted position to said elevated position.

4. The improvement of claim 3 wherein said piston comprises an upper seal member and a lower float carried thereby within said pressure chamber.

5. The improvement of claim 3 further including a piston rod connecting said piston to said cover.

6. The improvement of claim 3 further including at least one bleed port for bleeding pressurized water from said pressure chamber when the fountain is turned off.

7. The improvement of claim 6 wherein said at least one bleed port is formed in said body.

8. The improvement of claim 3 wherein said bubbler head discharge port is disposed in flow communication with said pressure chamber, and further including a flow restrictor carried by said bubbler head generally at said discharge port therein for maintaining a minimum threshold pressure within said pressure chamber when the fountain is turned on.

9. The improvement of claim 1 wherein said bubbler head discharge port is oriented for laterally outward projection of the water stream.

10. A covered bubbler head unit for use in a drinking fountain adapted for connection to a supply of water under pressure and including a control valve for selectively turning the fountain on and off, said covered bubbler head unit comprising:

a bubbler head having a discharge port formed therein for outward projection of a water stream therefrom when the fountain is turned on;

a protective cover having a generally inverted cup-shaped configuration, said protective cover being slidably mounted on said bubbler head for relative sliding displacement between an elevated position exposing said bubbler head discharge port for substantially unimpeded outward projection of the water stream therefrom, and a retracted position overlying and substantially concealing said bubbler head discharge port; and said bubbler head having a pressure chamber formed therein for connection to the pressurized water supply when the fountain is turned on, and a piston carried by said protective cover and slidably mounted within said pressure chamber, whereby said piston is movably displaced within said pressure chamber when the fountain is turned on for displacing said cover from said retracted position to said elevated position, and whereby said piston is movably displaced when the fountain is turned off from said elevated position to said retracted position.

11. The bubbler head unit of claim 10 wherein said bubbler head includes a radially outwardly projecting rim formed thereon for supporting a lower marginal edge of said cover in said retracted position.

12. The bubbler head unit of claim 10 further including a piston rod connecting said piston to said cover.

13. The bubbler head unit claim 10 further including at least one bleed port for bleeding pressurized water from said pressure chamber when the fountain is turned off.

14. The bubbler head unit of claim 10 wherein said bubbler head discharge port is disposed in flow communication with said pressure chamber, and further including a flow restrictor carried by said bubbler head generally at said discharge port therein for maintaining a minimum threshold pressure within said pressure chamber when the fountain is turned on.

15. The bubbler head unit of claim 10 wherein said piston comprises an upper seal member and a lower float carried thereby within said pressure chamber.

* * * * *